US007052346B1

(12) United States Patent
Childress

(10) Patent No.: US 7,052,346 B1
(45) Date of Patent: May 30, 2006

(54) X-STREAM WHITEWATER SUIT

(76) Inventor: Robert Childress, 8402 Sabal Industrial Blvd., Tampa, FL (US) 33619

( * ) Notice: Subject to any disclaimer, the term of this patent is extended or adjusted under 35 U.S.C. 154(b) by 0 days.

(21) Appl. No.: 10/998,442

(22) Filed: Nov. 29, 2004

(51) Int. Cl.
*B63C 9/08* (2006.01)

(52) U.S. Cl. ..... 441/106; 441/122

(58) Field of Classification Search ..... 441/88, 441/106, 110, 122, 108, 102, 114, 115
See application file for complete search history.

(56) References Cited

U.S. PATENT DOCUMENTS 1,611,427 A * 12/1926 Evans ..... 441/122
1,950,937 A * 3/1934 Lee ..... 441/110
2,111,358 A * 3/1938 Valentine ..... 441/122
4,555,234 A * 11/1985 Kent ..... 441/106
4,936,804 A * 6/1990 Dowdeswell ..... 441/122
4,936,805 A * 6/1990 Piatt, Jr. ..... 441/106
4,973,277 A * 11/1990 Khanamirian ..... 441/88

* cited by examiner

*Primary Examiner*—Lars A. Olson

(57) ABSTRACT

This equipment is made up of one torso protection piece, two forearm protectors and two lower leg protectors. The arm and leg protectors have fins or rudders to assist in steering through white water. The arm proctor fins may also be used as paddles in calm water. All the protection pieces have soft buoyant floatation material for comfort and helping stabilize the wearer in a face up position. This product will allow an individual to enjoy white water navigating in a higher degree of comfort and safety.

1 Claim, 3 Drawing Sheets

X-STREAM WHITEWATER SUIT

The X-Stream whitewater suit is designed for individuals who wish to ride rapids or swift flowing water, utilizing equipment that affords them an element of safety, comfort and an improved method of steering their bodies in swift water.

The suit consists of three areas of protection. The torso protector, the forearm and hand protector and the feet protector.

The torso protector is constructed of a molded rigid plastic back and moldable flotation material. It is secured in position by three stomach and chest straps and two shoulder straps. This part of the suit has a thin, approximately 1" layer of soft flotation material attached to the molded rigid back for comfort, graduating up to 4" at the front or neck, chest and stomach area. The thicker floatation material in the front allows for floatation and in the event the person is rolled face down the thicker floatation material in the front will assist in righting the individual allowing their face to be out of the water.

The forearm and hand protectors are constructed of a molded rigid plastic back with 1" soft floatation material on the inside for floatation and comfort. They are secured by two straps, one across the forearm and the other across the wrist. These pieces of gear have fins or rudders which allows the individual a degree of steering and when in calm water can be used for paddling.

The feet protectors are constructed of a molded rigid plastic back with l" soft floatation material on the inside for floatation and comfort. These pieces of gear have fins or rudders to assist in steering.

BRIEF SUMMERY OF INVENTION

This invention is intended to allow an individual to enjoy whitewater and or swift running water with a higher degree of protection, comfort and safety than possible with equipment currently available.

BACKGROUND OF INVENTOR

The inventor has enjoyed years of whitewater rafting, kayaking and tubing and was interested in a means of enjoying these activities in a more personal way, while providing a higher degree of control and safety.

The practical use of this product is to enable individuals to enjoy whitewater sports with a higher degree of safety and enjoyment.

Figure 1:
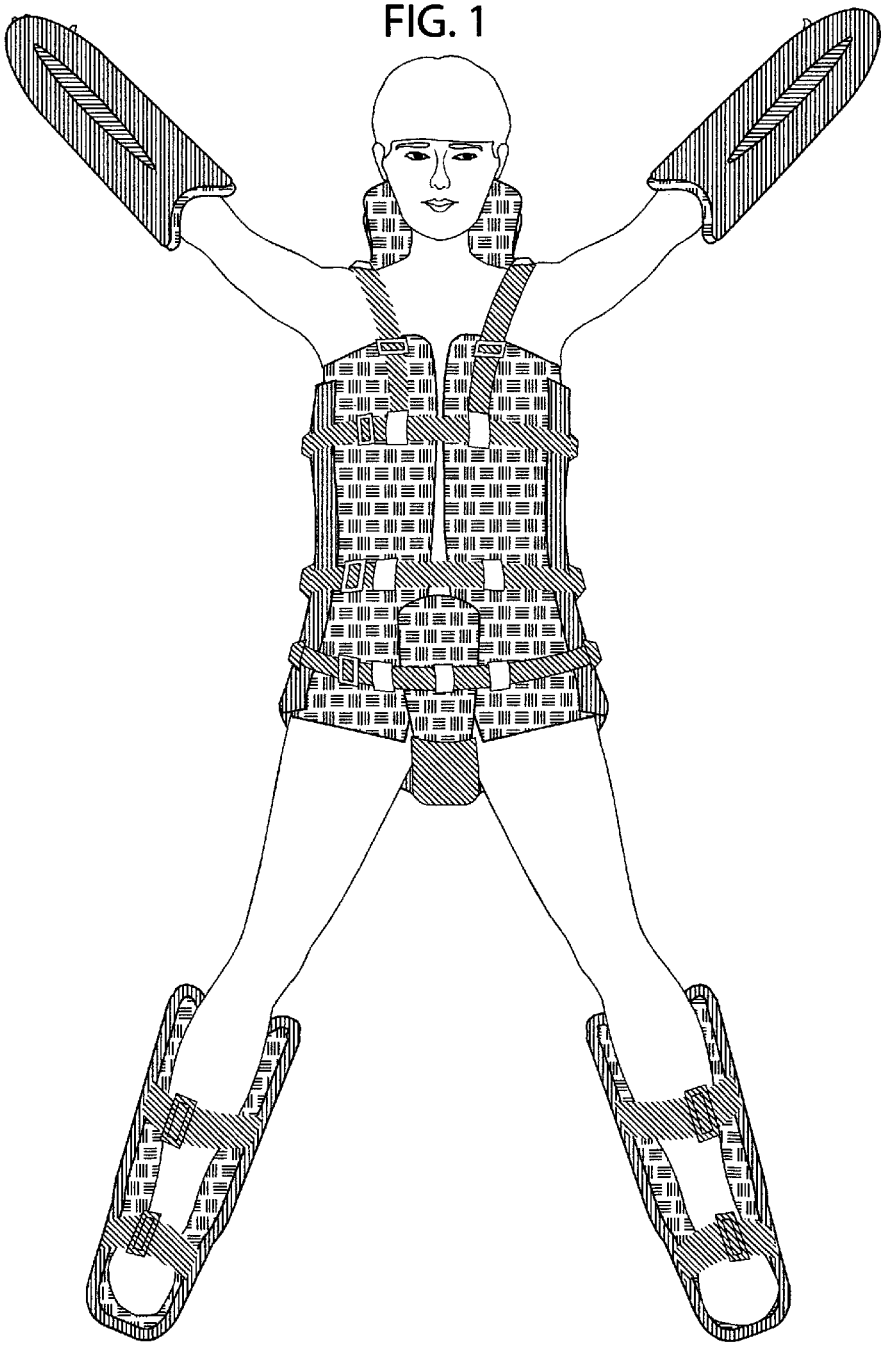

Drawing FIG. 1.
Front view, while being worn

Figure 2:
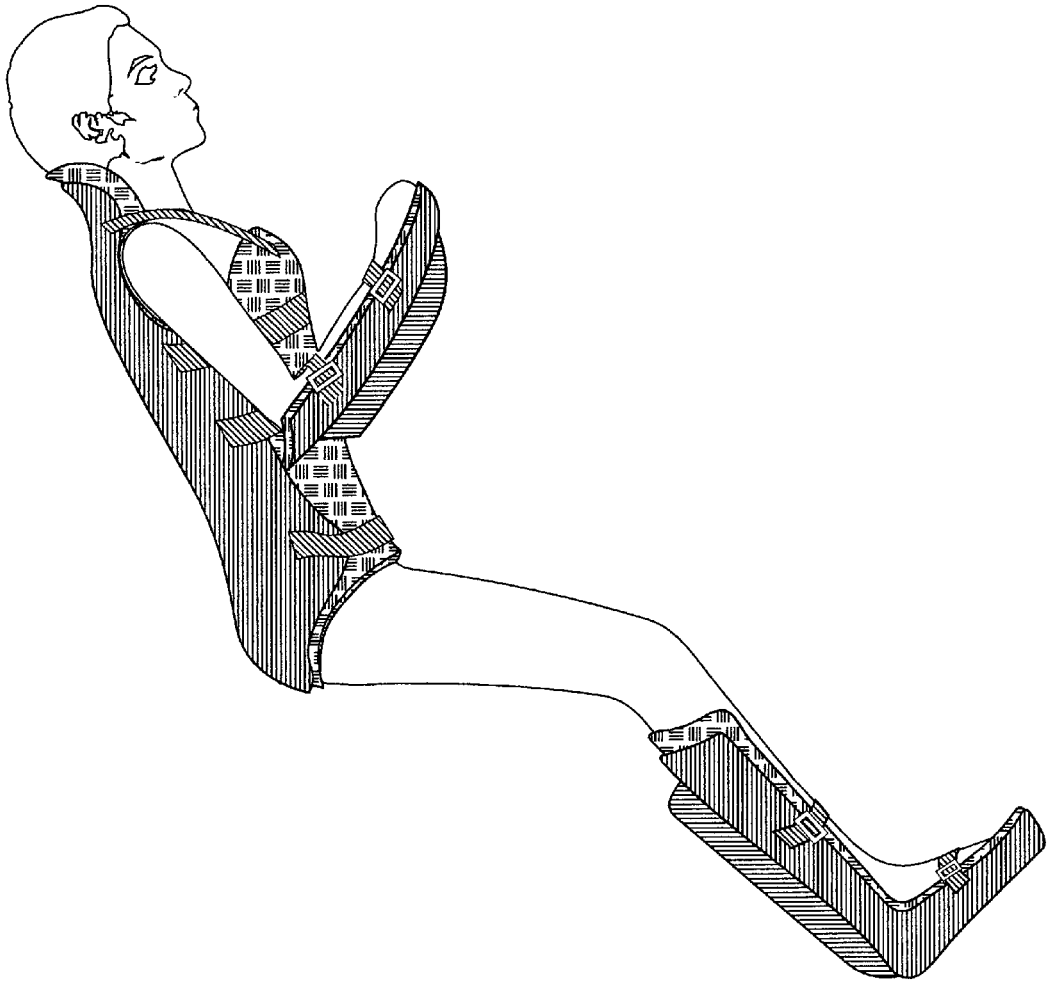

Drawing FIG. 2.
Side view, while being worn

Figure 3:
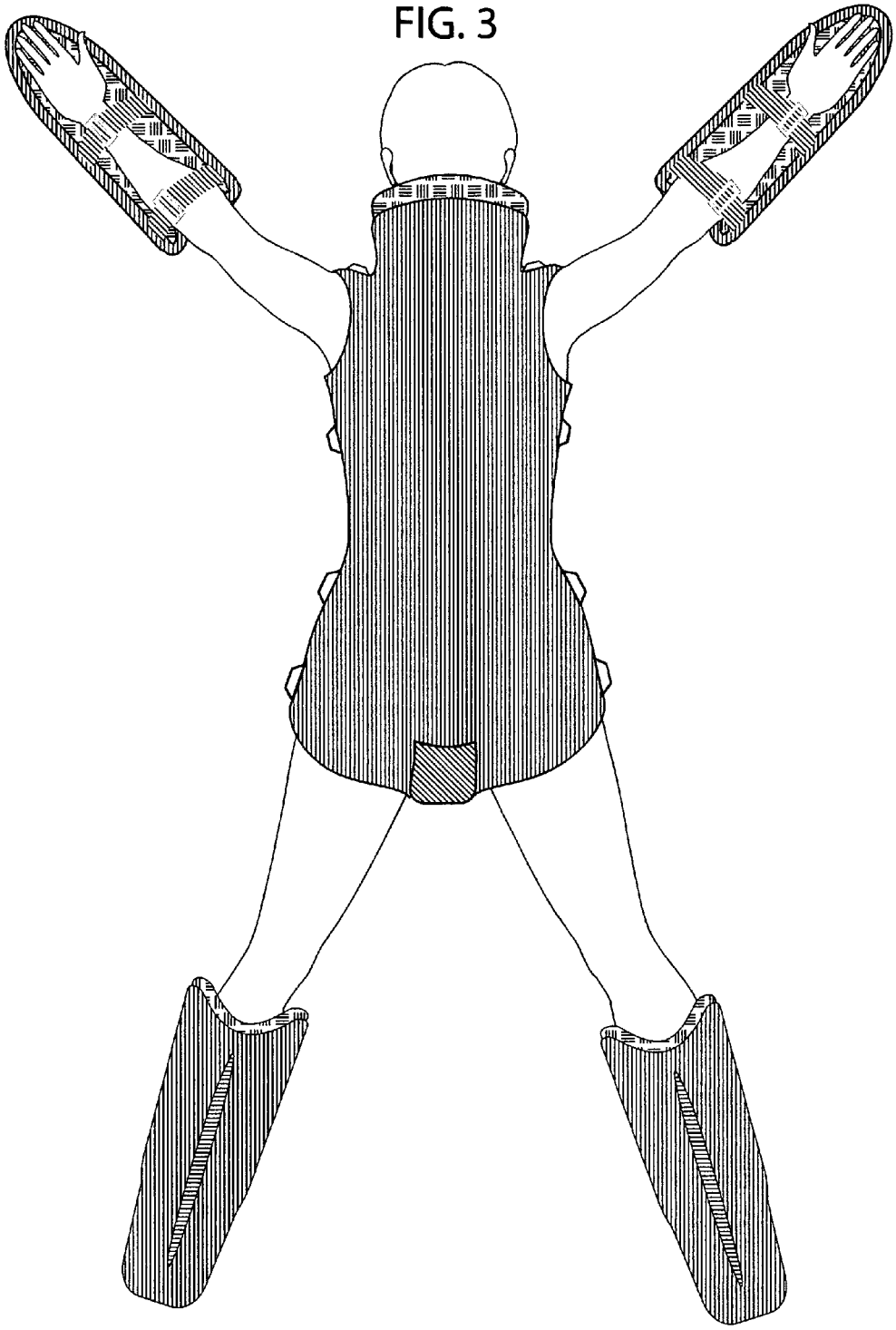

Drawing FIG. 3.
Back view, while being worn

The invention claimed is:

1. A suit to be worn by an individual allowing for body protection and flotation while enjoying the activity of riding white water rapids; said suit being different from other flotation devices in as much as it has a rigid plastic shell that protects a wearer from rocks or other areas of danger that may injure the wearer and consists of three areas of protection, a torso protector, a forearm and hand protector and a feet and lower leg protector and are constructed of a molded rigid plastic back with flotation material lining the rigid plastic and secured in position by adjustable straps; a thin, approximately 1" layer of soft flotation material is attached to the molded rigid back for comfort and floatability, graduating up to 4" at the front and sides of the neck, chest and stomach areas; this graduation of flotation material allows for additional flotation in the front to assist in righting the individual, allowing their face to be out of the water; forearm and hand protectors are constructed of the same molded rigid plastic as the torso protector with a 1" soft flotation material on the inside for flotation and comfort and secured to the wearer by two straps, one across the forearm and the other across the wrist and said forearm and hand protectors have fins or rudders which allows the individual a degree of steering in swift water and when in calm water can be used for paddling; feet protectors are constructed of the same molded plastic as the torso and forearm protectors with 1" soft flotation material on the inside for flotation and comfort and attach to the wearer with two straps across the shin and top of the foot and also have fins to assist steering.

* * * * *